US005680715A

United States Patent [19]

Thiboutot et al.

[11] Patent Number: 5,680,715

[45] Date of Patent: Oct. 28, 1997

[54] MACHINE FOR PACKING SNOW OR THE LIKE ALONG A TRAIL

[75] Inventors: Bruno Thiboutot; Normand Thiboutot, both of St-André-de-Kamouraska, Canada

[73] Assignees: Garage N. Thiboutot Inc.; Gestion Normand Thiboutot Inc., both of Quebec, Canada

[21] Appl. No.: 566,565

[22] Filed: Nov. 28, 1995

[51] Int. Cl.[6] ..... A63C 19/10; E01C 19/22; E01C 4/00

[52] U.S. Cl. ..... 37/219; 37/268; 180/14.2; 172/684.5

[58] Field of Search ..... 37/219, 220, 268, 37/266; 172/781, 786–788, 684.5; 180/9.1, 9.32, 14.2, 14.3, 14.4, 14.7; 299/30, 36.1; 404/101, 110, 96, 75, 91

[56] References Cited

U.S. PATENT DOCUMENTS

| | | | |
|---|---|---|---|
| D. 258,887 | 4/1981 | Swisher et al. | D15/24 |
| D. 266,850 | 11/1982 | Godbersen | D15/22 |
| D. 346,388 | 4/1994 | Sibernagel | D15/22 |
| 1,269,098 | 6/1918 | Latta | 404/91 |
| 1,796,166 | 3/1931 | Sharp . | |
| 2,746,181 | 5/1956 | Molene et al. | 172/684.5 |
| 3,043,034 | 7/1962 | Kober | 172/684.5 X |
| 3,044,193 | 7/1962 | Zamboni | 37/219 |
| 3,339,658 | 9/1967 | Peterson | 180/14.2 |
| 3,371,586 | 3/1968 | Nikolaev et al. . | |
| 3,454,123 | 7/1969 | Lewis . | |
| 3,533,337 | 10/1970 | Swisher, Jr. | 404/118 X |
| 3,540,359 | 11/1970 | Swisher, Jr. | 404/118 X |
| 3,650,343 | 3/1972 | Helsell | 180/5 R |
| 3,652,106 | 3/1972 | Waterman | 280/405 R |
| 3,915,239 | 10/1975 | Hendrichon | 172/146 |
| 3,926,262 | 12/1975 | Brooks | 37/219 |
| 3,972,158 | 8/1976 | Lindström | 56/13.6 |
| 4,019,268 | 4/1977 | Waterman | 37/10 |
| 4,028,820 | 6/1977 | Simonds, Jr. | 37/41 |
| 4,056,328 | 11/1977 | Maxey | 172/787 X |
| 4,127,949 | 12/1978 | Sabrowsky et al. | 37/220 X |
| 4,139,318 | 2/1979 | Jakob et al. | 404/90 |
| 4,140,186 | 2/1979 | Stedman | 172/292 |
| 4,202,118 | 5/1980 | Held | 37/219 |
| 4,244,662 | 1/1981 | Olson | 404/118 |
| 4,391,051 | 7/1983 | Bachler | 404/96 X |
| 4,650,018 | 3/1987 | Silverman, Sr. | 180/14.7 |
| 5,000,615 | 3/1991 | Murray | 404/101 X |
| 5,113,958 | 5/1992 | Holden | 180/9.1 X |
| 5,265,356 | 11/1993 | Winter | 37/234 |
| 5,361,519 | 11/1994 | Ciula et al. | 37/234 |
| 5,441,361 | 8/1995 | Campbell | 404/91 X |

FOREIGN PATENT DOCUMENTS

| | | | |
|---|---|---|---|
| 405131950 | 5/1993 | Japan | 180/14.2 |

*Primary Examiner*—Terry Lee Melius
*Assistant Examiner*—Thomas A. Beach
*Attorney, Agent, or Firm*—Fishman, Dionne, Cantor & Colburn

[57] ABSTRACT

The machine incorporates a front and a rear motorized units operatively connected together, and in which power is transmitted from one unit to the other so that they are both serf-propelled. A snow levelling device is disposed between the two motorized units for breaking irregularities on the trail and delivering excess snow behind the rear unit. A compaction and levelling unit is placed at the rear of the rear unit. Both the snow levelling device and the compaction and levelling unit may be raised from the ground especially in case of difficulties. This arrangement does not usually become inoperative in heavy snow or on inclined surfaces.

20 Claims, 6 Drawing Sheets

MACHINE FOR PACKING SNOW OR THE LIKE ALONG A TRAIL

BACKGROUND OF INVENTION (a) Field of the Invention

This invention relates to a machine for packing snow. More particularly, the present invention is concerned with a snow packing machine which is especially useful for upkeeping or dressing snowmobile trails which require that the surface be well groomed if safety and enjoyment are to be maintained.

(b) Description of Prior Art

Riding a snowmobile is an outside activity which attracts an increasing number of enthusiasts. However, since we are dealing with a motorized equipment, restrictions are necessarily imposed. This is the reason why presently, snowmobiles are most exclusively present on trails which are maintained by governmental or private authorities and are restricted for use by snowmobiles. Because there is some danger in driving a snowmobile and also in view of the fact that the comfort of the passengers is essential if substantial distances are envisaged, the trails should be properly managed or dressed such as by grading, levelling and compacting the snow. Now, since these trails extend often over very irregular surfaces, their levelling, dressing and compaction are in many cases quite difficult to achieve.

Presently, it is common to use a snow track vehicle having a snow plough mounted in the front and which pulls a levelling and compacting device at its rear. The main difficulty with this type of equipment is that following a heavy snow fall or when working on a sharply inclined surface, the motorized vehicle may get stock, to the extent that sometimes the levelling and compacting device has to be detached from the snow track vehicle, in order to be able to displace the latter so as to be in a better position for attaching again the levelling and compacting device and resuming the operation. In addition, since only one levelling and packing device is being provided and which is pulled by the vehicle, the treatment is not always as satisfactory as would be expected. There is therefore a need for a machine which is easier to operate in that it would not easily get stock, and which at the same time ensures well maintained snowmobile trails.

Snow packing machines are well known, such as disclosed in U.S. Pat. Nos. 1,796,166 issued March 10, 1931, J. A. Sharp; 3,650,343 issued Mar. 21, 1972, John B. Hellsell; 3,371,586 issued Mar. 5, 1968, A. F. Nikolaev et al.; 4,019,268 issued Apr. 26, 1977, D. H. Waterman. The Hellsell patent proposes to use a front wide unit and a rear narrow unit thereby covering a relatively wide area in one passage. The other references all relate to a front vehicle which is used to pull a levelling and/or packing device, with the inherent disadvantages mentioned above.

Snow groomers are also known such as in U.S. Pat. No. 3,915,239 issued Oct. 28, 1975, Lucien Hendrichon and U.S. Pat. No. 4,244,662 issued Jan. 13, 1981, James L. Olson. These pieces of equipment are all moved by means of a single motorized unit with all the disadvantages inherent thereto.

There is thus a need for a piece of equipment which can operate to provide a good surface for snowmobile trails or the like, and which does not normally become inoperative in heavy snow or inclined surfaces.

SUMMARY OF INVENTION

It is therefore an object of the present invention to provide a piece of equipment for dressing snowmobile trails which is devoid of the disadvantages of presently used equipments.

It is another object of the present invention to provide a machine for packing snow along snowmobile trails or the like which incorporates two motorized units, a snow levelling unit disposed between the two motorized units and a compaction and levelling unit placed behind the rear motorized unit.

It is another object of the present invention to achieve a better dressing of snowmobile trails or the like than heretofore known.

These and other objects of the invention may be achieved by providing a machine for packing snow, which comprises:

- a first motorized unit and a second motorized unit, each unit having means enabling it to move over a surface covered with snow as well as a rough uneven terrain;
- means connecting the first motorized unit ahead of the second motorized unit;
- the machine including steering means enabling it to change direction;
- the connecting means comprising articulating means enabling to change the course of the machine by operating the steering means, and means to permit one unit to pivot about a longitudinal axis independently of the other unit;
- snow levelling means disposed between the first and second motorized unit and carried by the connecting means to ride over a snow surface for breaking and levelling irregularities in the snow surface and delivering excess snow rearwardly of the second motorized unit;
- means for packing snow including the excess snow arranged behind the second motorized unit;
- means connecting the snow packing means to the second motorized unit for pulling it while allowing it to slide over snow including said excess snow and that leveled by means of the snow levelling means; and
- means permitting said snow levelling means and said snow packing means to be raised from or lowered into ground engaging positions thereof.

In accordance with an embodiment of the invention, the first and second motorized units are each provided with self-propelling means, and the machine comprises means effective to cause simultaneous operation of both self-propelling means, the self-propelling means being arranged to enable the first and second motorized units to travel exactly at the same speed.

In accordance with another embodiment, the machine comprises motor means disposed in one motorized unit, preferably the second motorized unit, and arranged to operate the first and second motorized units so as to cause them to be simultaneously self-propelled.

In accordance with another embodiment, the first motorized unit comprises first driving means and the second motorized unit comprises second driving means. The machine also comprises a main drive shaft having an inner end and an outer end, the inner end being operatively connected to the motor means. The outer end is connected to a transfer case, a first auxiliary shaft is connected between the transfer case and the first driving means to operate the latter. A second auxiliary shaft is connected between the transfer case and the second driving means to operate the latter, so that both the first and second driving means are simultaneously operated by the motor means.

In accordance with another embodiment, the first motorized unit comprises a first frame, a pair of first drive wheels and a pair of first non driven wheels mounted on the first frame, first and second tracks, each respectively engaged over a first drive wheel and a first non driven wheel on both sides of the first motorized unit, the first auxiliary shaft being operatively connected to the first drive wheels to drive the first motorized unit.

In accordance with yet another embodiment, the second motorized unit comprises a second frame, a pair of second drive wheels and a pair of second non driven wheels mounted on the second frame, third and fourth tracks, each being respectively engaged over a second drive wheel and a second non driven wheels on both sides of the second motorized unit. The second frame also has a motor mounted thereon, the motor being arranged to operate the main drive shaft, the second auxiliary drive shaft being operatively connected to the second drive wheels to drive the second motorized unit.

In accordance with another embodiment, the machine comprises transmission means, preferably an automatic transmission, associated with the motor, to transfer power from the motor to the main drive shaft and thereby to the first and second drive wheels through the first and second auxiliary drive shafts.

In accordance with a preferred embodiment, the connecting means comprise at least two parallel beams mounted on the second frame and extending along the longitudinal axis of the second motorized unit. The beams are joined together at theft outer end by means of a transverse connecting bar, and have means located intermediate between the outer end and the second motorized unit to adjustably hold the snow levelling means. The beams also comprise hitching means for coupling the beams to the first motorized unit so that the first motorized unit can be articulated about a vertical axis with respect to the beams, and be allowed to pivot about the longitudinal axis, relative to the beams and the second motorized unit.

BRIEF DESCRIPTION OF DRAWINGS

Other details and characteristics of embodiments of the invention will appear from the following drawings which are given only for the purpose of illustration and without limitation, in which.

DESCRIPTION OF PREFERRED EMBODIMENTS

Figure 1:
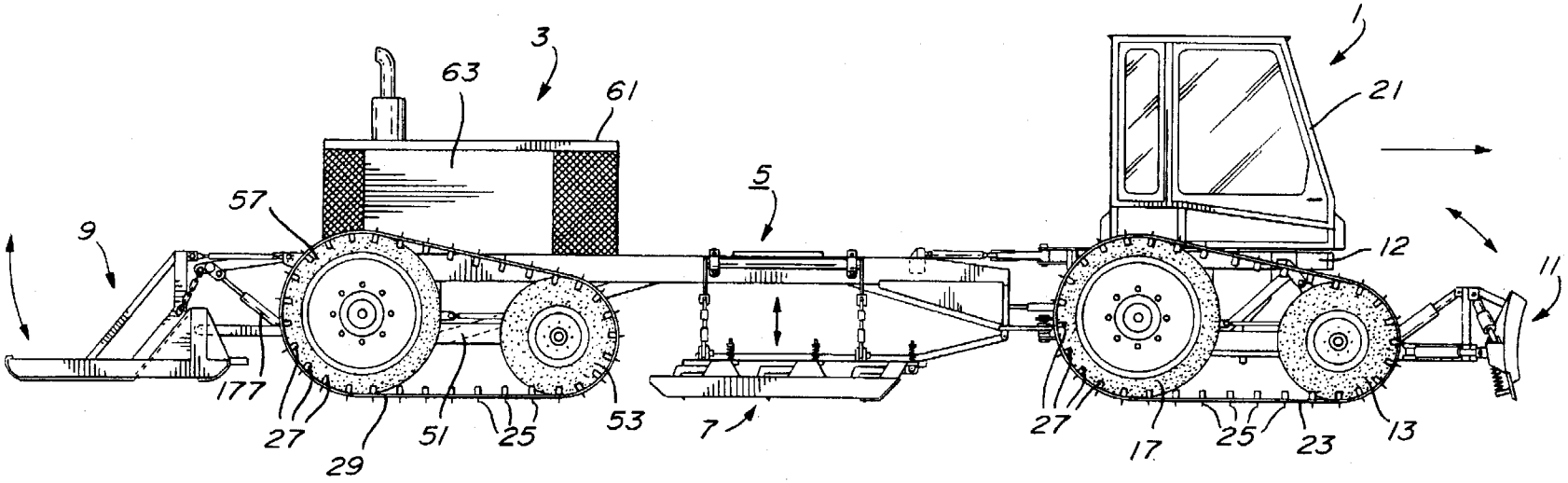
FIG. 1 is a longitudinal elevation view of a machine for packing snow according to the invention.
Figure 2:
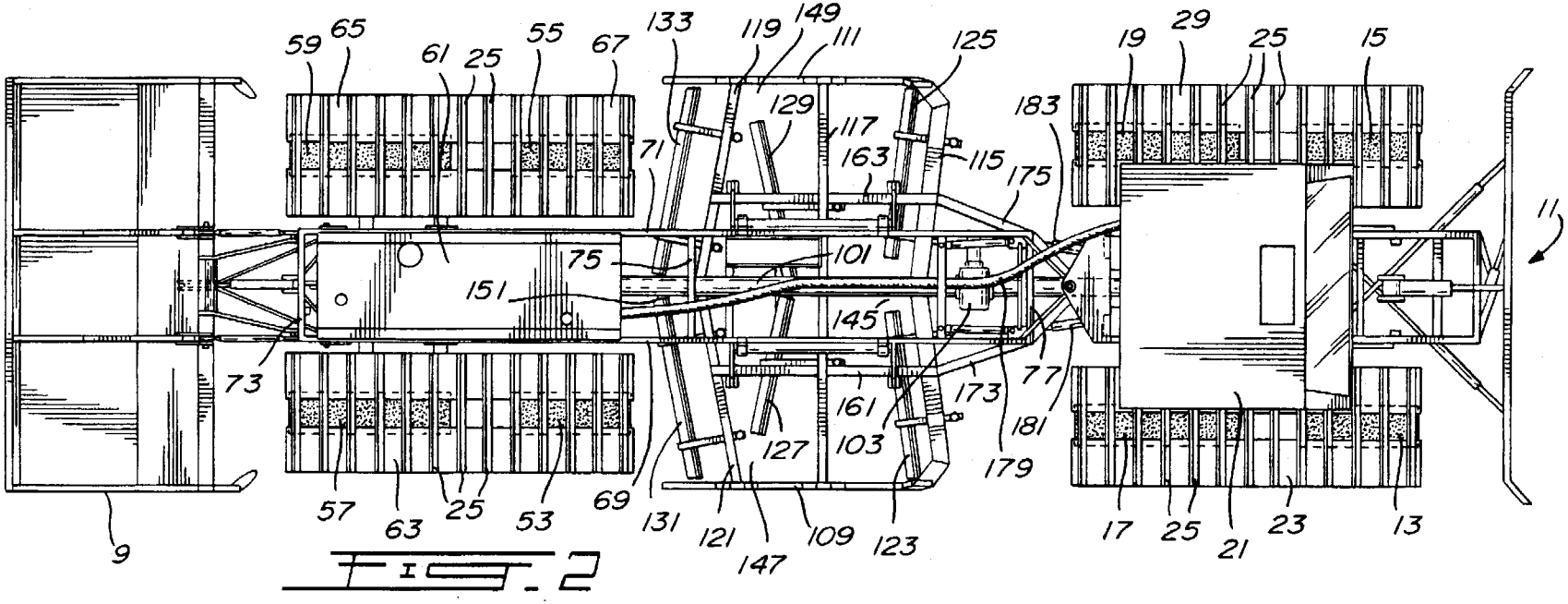
FIG. 2 is a view from above of the machine illustrated in FIG. 1.

With reference to the drawings, particularly FIGS. 1 and 2, it will be seen that the machine for dressing and packing snow in a snowmobile trail or the like such as a ski trail or slope, which has been illustrated, generally comprises a front motorized unit 1, a rear motorized unit 3, a connection 5 to join the front and rear motorized units 1 and 3, a snow levelling device 7 disposed between the two motorized units 1 and 3, and a snow levelling and packing device 9 arranged rearwardly of the rear motorized unit 3. Finally, the from motorized unit 1 has a snow plough 11 of standard construction and mounted in known manner at the front thereof.

As will be discussed, to be fully operable and provide advantages over prior art machines, both motorized units 1 and 3 have to be self-propelled, so that any resistance exerted by snow levelling device 7 and snow packing unit 9 is distributed in the two motorized units 1 and 3.

With particular reference to FIGS. 1–6 and 9, the connection 5 between front motorized unit 1 and rear motorized unit 3 will now be described.

Front motorized unit 1 is formed of a chassis consisting of a frame generally designated 12, a pair of front wheels 13, 15 and a pair of rear wheels 17,19, the chassis being surmounted by a cabin 21 of known construction. As will be discussed later, wheels 13,15 are non driven wheels and wheels 17,19 are drive wheels. A track 23 of standard construction provided with engaging grips 25 and guides 27 is mounted around drive wheel 17 and non driven wheel 13. A track 29, similar to track 23 is mounted over drive wheel 19 and non driven wheel 15.

Figure 3:
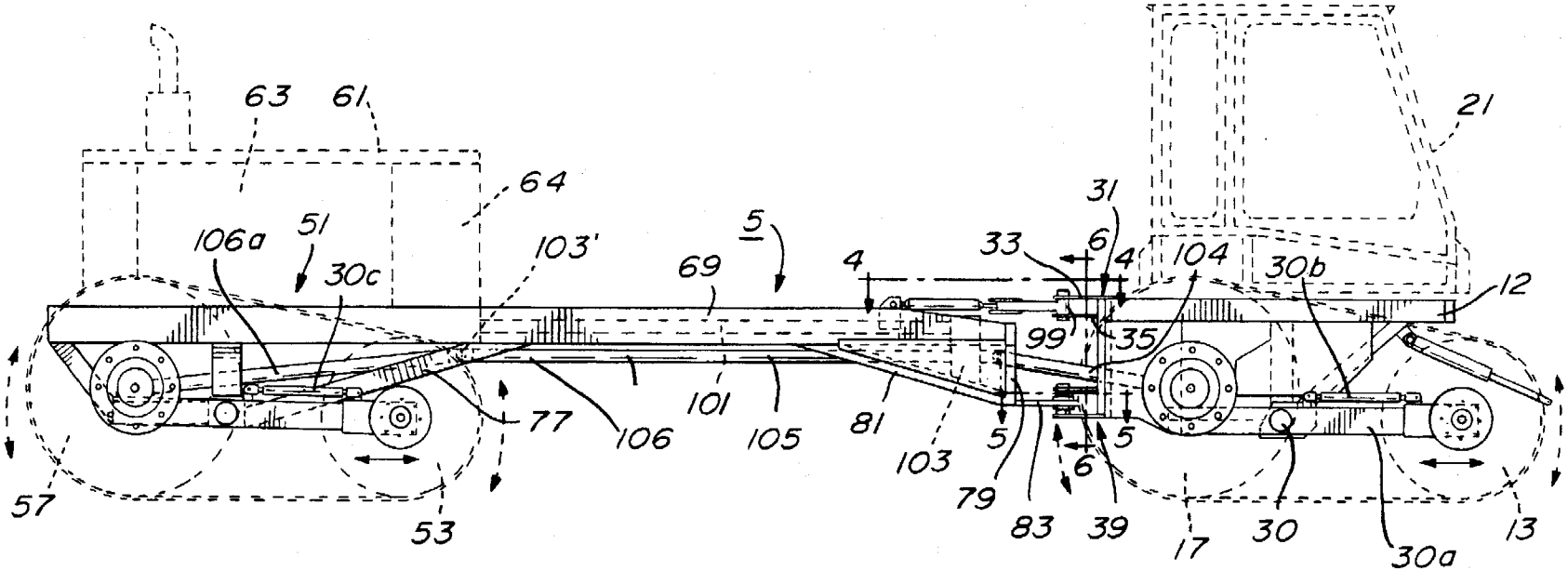
FIG. 3 is a longitudinal view of the connection arrangement of the two motorized units.
Figure 4:
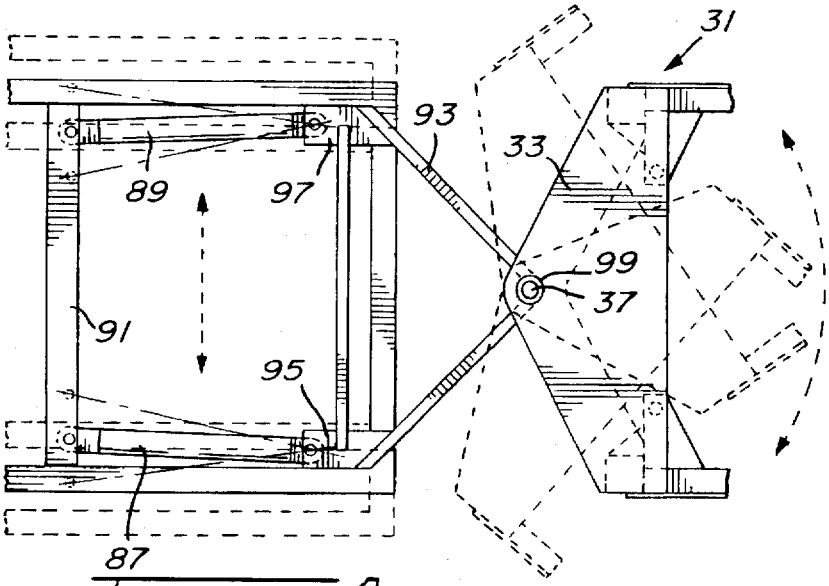
FIG. 4 is a cross-section view taken along line 4—4 of FIG. 3.
Figure 5:
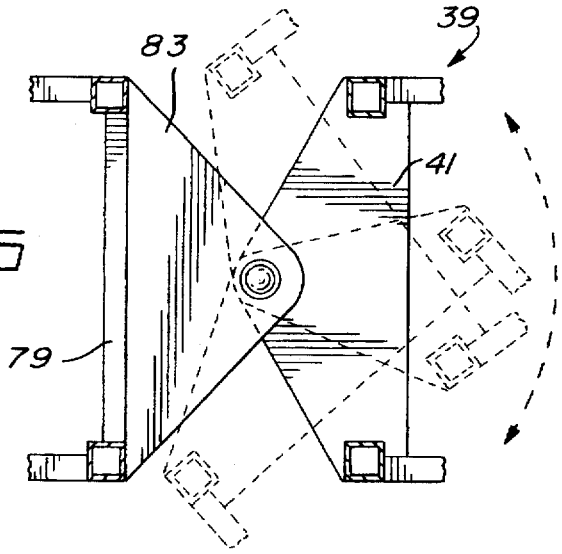
FIG. 5 is a cross-section view taken along line 5—5 of FIG. 3.

With particular reference to FIG. 3, it will be seen that a transverse pivot rod 30 is mounted on frame 12 to extend outwardly on both sides thereof. A tandem arm 30*a* is mounted on pivot rod 30 to pivot on both sides of the frame, and wheels 13,17 and 15,19 are rotatably mounted at both ends of each tandem arm 30*a*. This arrangement enables the drive wheels and non driven wheels to follow any irregular contour of the ground. In addition, it will be seen that proper tension of tracks 23,29 is ensured by extending or retracting mechanical jacks 30*b*, 30*c*. The drive wheels 17,19 are operated by a well known axle (not shown including a differential and a planetary reduction), which receives power from a first auxiliary drive shaft that will be described later.

Figure 6:
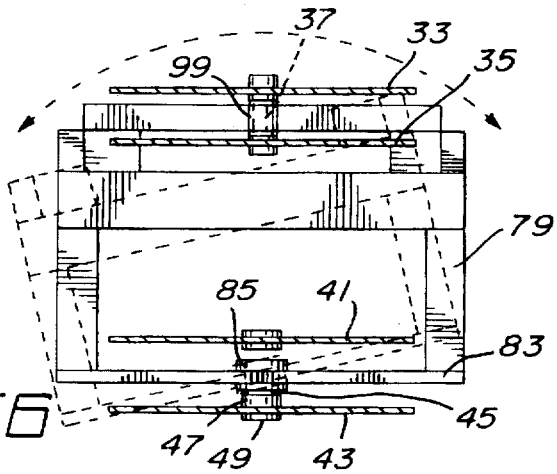
FIG. 6 is a cross-section view taken along line 6—6 of FIG. 3.

With particular reference to FIGS. 3 and 6, it will be seen that an upper triangular bracket 31 comprising two spaced triangular plates 33,35, is attached in known manner on the upper part and at the rear of frame 12, more particularly, as shown in FIGS. 1 and 3. At the apex of the triangular plates 33,35, there is a pivot pin 37 mounted in known manner which enables to attach connection 5 to bracket 31 as will be discussed later. In addition, a lower triangular bracket 39 is provided on frame 12, at the bottom part thereof. As in the case of bracket 31, and as particularly shown in FIGS. 3 and 6, bracket 39 consists of two spaced triangular plates 41,43 which are attached in known manner at the lower part and at the rear of frame 12. A hitch ball of which only flange 45 is shown is mounted to be retained between triangular plates 41,43, more particularly it is held in known manner by disc member 47 which is fixed at the apex of plate 43 by means of holding member 49.

Turning now to rear motorized unit 3, and with particular reference to FIGS. 1, 2 and 3, the latter will be seen to consist of a chassis which includes a frame generally designated 51, a pair of front wheels 53,55 and a pair of rear wheels 57,59. The chassis is surmounted by an enclosure 61 which constitutes the housing for a motor and a transmission which are shown schematically at 63,64. As will be discussed later, front wheels 53,55 are non driven wheels and rear wheels 57,59 are drive wheels. Track 65 of standard construction and similar to track 23 is mounted around drive wheel 57 and non driven wheel 53, while track 67 is mounted around drive wheel 59 and non driven wheel 55. The drive wheels 57,59 and non driven wheels 53,55 are mounted in tandem similarly as in front unit 1 and for the same purpose.

With respect to connection 5, and with particular reference to FIGS. 2 and 3, the latter will be seen to consist of two elongated beams 69,71 mounted in parallel and fixed in known manner at their inner ends to the upper part of frame 51 of the rear motorized unit 3. Beams 69,71 are on the other hand fixed together by means of transverse members such as 73,75. Of course any other means of maintaining the beams rigid and parallel to one another are possible according to the present invention, the choice being entirely left to one skilled in the art. In the illustrated embodiment, the beams are also held rigid and parallel to the longitudinal axis of the machine by means of angularly mounted braces 77, only one being shown in the drawings.

Referring now more particularly to FIGS. 3–6 and 9, a more detailed description of connection 5 to front motorized unit 1 will now be given. A rectangular frame 79 is mounted vertically at the outer ends of beams 69,71 to project downwardly therefrom. Frame 79 is fixed in known manner such as by soldering and is fixedly held in that position by means of a pair of braces 81 which extend from a point short of the end of each beam to the lower end of frame 79. A triangular plate 83 fixed in known manner at the lower end of frame 79 extends horizontally and has its apex provided with a hook member 85 which is engaged over the hitch ball of which only flange 45 is illustrated. As shown more particularly in FIGS. 3 and 6, triangular plate 41 prevents hook member 85 from being disengaged over the hitch ball. Of course, hook member 85 and the hitch ball are constructed to permit them to rotate in all directions.

Connection 5 is also connected to the upper part of frame 12 of motorized unit 1, more particularly through pivot pin 37. For this purpose, there is provided an upper attachment of special design which is fixed at the outer ends of beams 69,71. As shown, this attachment comprises a pair of pivoting arms 87,89 which are mounted to articulate at their inner ends on a transverse piece 91 disposed between beam. 69,71 short of the ends thereof. A joint attachment 93, in the form of a triangle has pivot connectors 95,97 provided at both ends of the triangle base as particularly shown in FIGS. 4 and 9. The outer ends of pivoting arms 87,89 are pivotally connected respectively in pivot connections 95,97. The joint attachment 93 is terminated by a sleeve 99 which engages over pivot pin 37. It will therefore be realized that with this construction, when motorized unit 1 merely pivots about a vertical axis the pivoting arms 87,89 will remain parallel to beams 69,71. However, if the front motorized unit undergoes a torsion about a longitudinal axis, the pivoting arms 87,89 will pivot at both ends, as particularly shown in FIG. 9, thereby preventing beams 87,89 and consequently the rear motorized unit 3 from undergoing a similar torsion. This is particularly important, because this machine is normally used on a surface which is very irregular, where the different parts will be subject to countless rotations and torsions. As the machine is not designed for forward and rearward tilting of the units with respect to one another, irregularities in ground surfaces are taken up by the tandem arrangement of the drive wheels and non driven wheels, as discussed above.

As mentioned above, this machine operates with two self-propelled units, here motorized units 1 and 3, with one motor only being provided, here in rear unit 3. To achieve this, the machine comprises a main drive shaft 101 which extends all the way from automatic transmission 64 to transfer case 103. A first auxiliary drive shaft 104 is connected between transfer case 103 and the driving means (not shown) including an axle and a differential and planetary reduction assembly, enabling to drive drive wheels 17,19. The machine also includes a second auxiliary shaft 105 which is connected between transfer case 103 rearwardly towards rear motorized unit 3. More particularly, the second auxiliary shaft 105 extends a certain distance parallel to beams 69,71 for a first section 106 where it is jointed to a second section **106*a* by means of a yoke connection 103'. The second section 106*a* is directed toward the driving means (not shown including another axle and a differential planetary reduction assembly) for driving drive wheels 57,59**.

An important part of the machine according to the invention is snow levelling device 7 because its construction and arrangement between the two motorized units 1 and 3 constitutes a substantial aspect of the invention.

Figure 7:
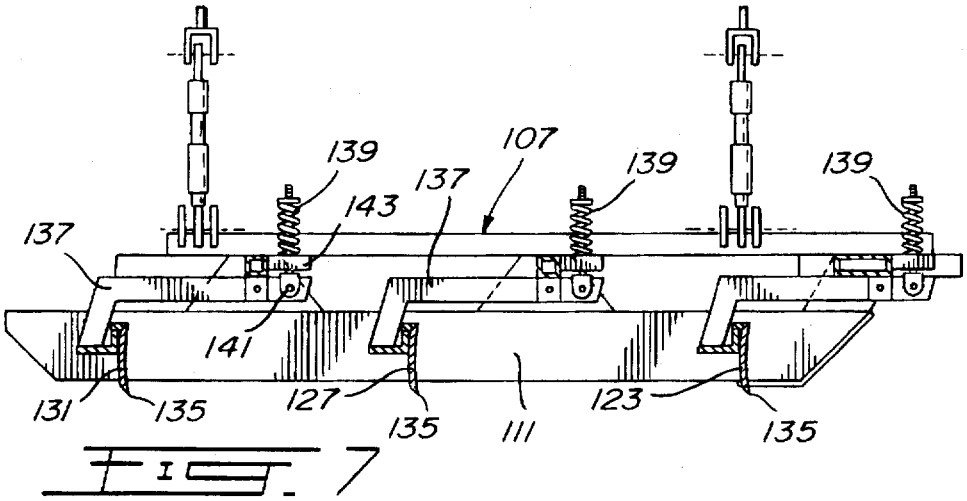
FIG. 7 is a view in elevation, partly in cross-section of the snow levelling device.

The device itself is more particularly illustrated in FIGS. 1, 2 and 7 and reference will be made thereto for a detailed description of the device. As shown, it comprises a frame 107 including longitudinal lateral members 109,111, a V-shaped front member 115, transverse brace 117 and slanted transverse members 119,121. The device essentially includes three pairs of vertically mounted snow cutting and ploughing blades, namely front blades 123,125, middle blades 127,129 and rear blades 131,133. As illustrated, the blades are shaped as elongated plates each formed with a sharp edge 135 at the lower end thereof. Also, the blades are all similarly mounted on frame 107 by means of lever type brackets 137, which are each associated with a coil spring 139 enabling vertical upward and downward movements of the blades when required when there are obstacles on the ground. More particularly, a bracket 137 is pivoted at 141 and is provided with a rest 143 against which sits the base of spring 139. Of course any other means for permitting a resilient action on the blades following an upward pressure exerted thereon is within the scope of the present invention, as will be appreciated by one skilled in the art.

With particular reference to FIG. 2, it will be seen that blades 123,125 are mounted so that their outer ends correspond respectively to lateral members 109, 111 and their inner ends leave a free space 145 therebetween. Furthermore, by slanting blades 123,125 so that their inner ends is back of their outer ends along the path of the trail to be dressed, it will be seen that any excess snow picked up by blades 123,125 will have a tendency to pass rearwardly through free space 145. Turning now to middle blades 127,129, they are oppositely disposed as compared to blades 123,125, i.e. their inner ends meet, and they are slanted so that their outer ends are behind the inner ends, thereby leaving outer free spaces 147,149 on the sides of the path. Finally, rear blades 131,133 are mounted rearwardly of middle blades 127,129, similarly as blades 123,125, leaving a free space 151 therebetween. So, when dragging snow levelling device 5 along a trail, any irregularity in the surface will be broken up and the excess snow that may be accumulated as a result of this dragging will escape through spaces 145, 147 and 149, and 151, to end up between tracks 63,65 and finally behind motorized unit 3, to be packed by means of levelling and packing device 9.

Figure 10:
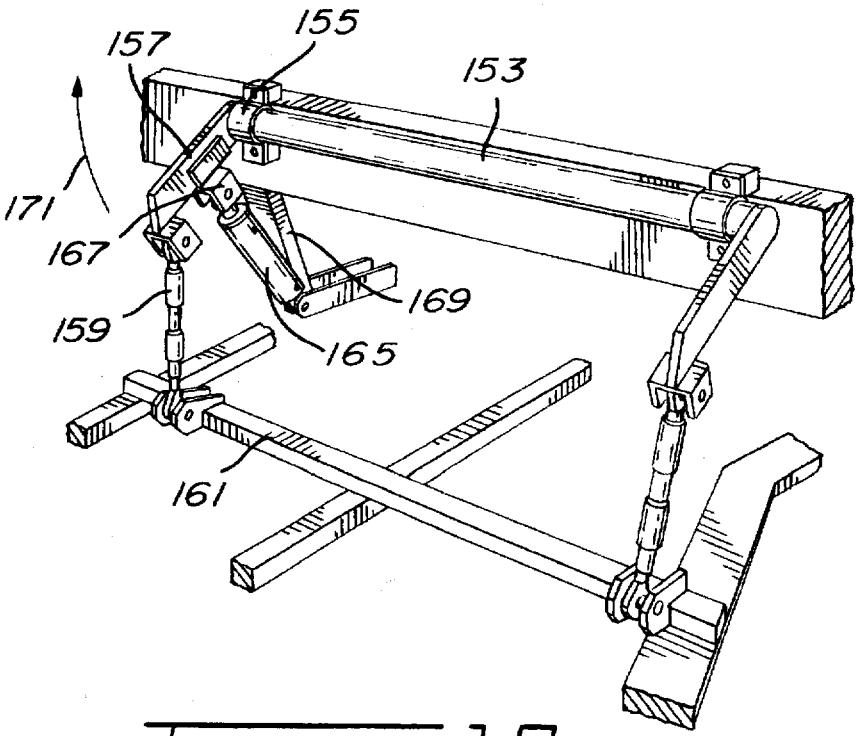
FIG. 10 is a perspective view of the connection of the snow levelling device to the beams between the two motorized units.

As previously indicated, snow levelling device 7 is held by means of connection 5. More particularly, and with reference to FIGS. 1 and 10, it is important first to adjust the exact height of the device relative to the machine and to the surface to be treated and second to be able to lift one or both sides when necessary. To achieve this, there is provided a leverage rod 153 which is mounted to rotate on beam 69 by means of sleeve 155. Of course, any number of sleeves as required may be used. The leverage rod has lever arms 157 at both ends thereof. Mechanical links 159 which are adjustable in length are pivotally connected at one end to a longitudinal brace 161,163 of frame 107, and at the other end to the free end of a lever arm 157. In addition, there is provided a hydraulic jack 165 which is pivotally connected at one end at 167 along lever arm 157 and at the other end to a beam bracket 169 downwardly extending from beam 69,71. So, if one intends to lift one side of the snow levelling device, hydraulic jack 165 is extended to a desired extension which will cause the other lever arm 157 to move in the direction of arrow 171 and pull the other mechanical link 159. If both sides are to be lifted and consequently the entire snow levelling device 7, the jacks on both sides of the snow levelling device 7, are extended. If the snow levelling device, on the other hand, is not properly adjusted for a normal operation, it is merely sufficient to make the necessary adjustment using the length adjustable mechanical links 159.

Finally, it will be noted that to prevent any forward and rearward movement of the snow levelling device 7 when the machine is in operation, it is fixed to flame 79 by means of braces 173,175.

Figure 8:
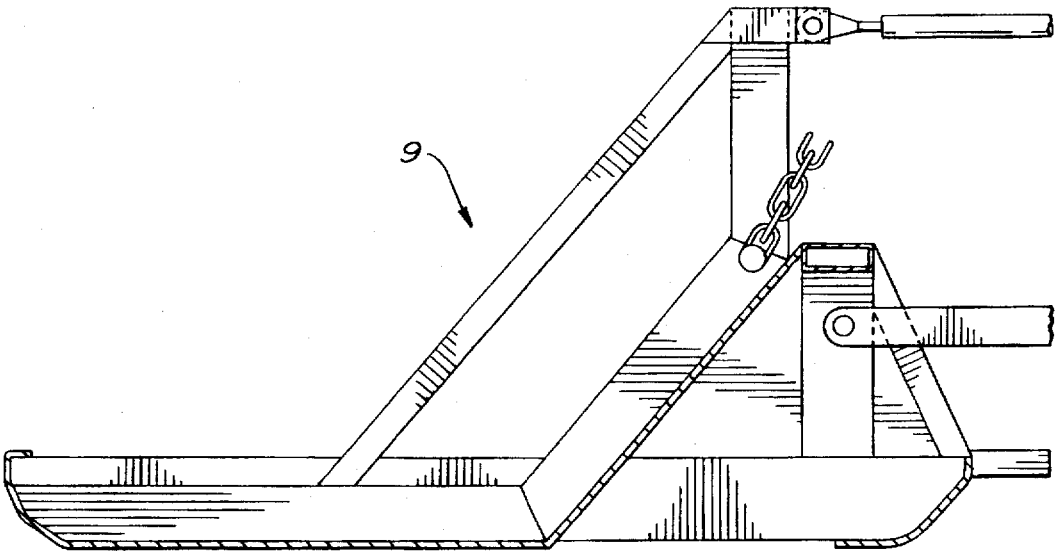
FIG. 8 is a view in elevation, partly in cross-section of the snow packing device.
Figure 9:
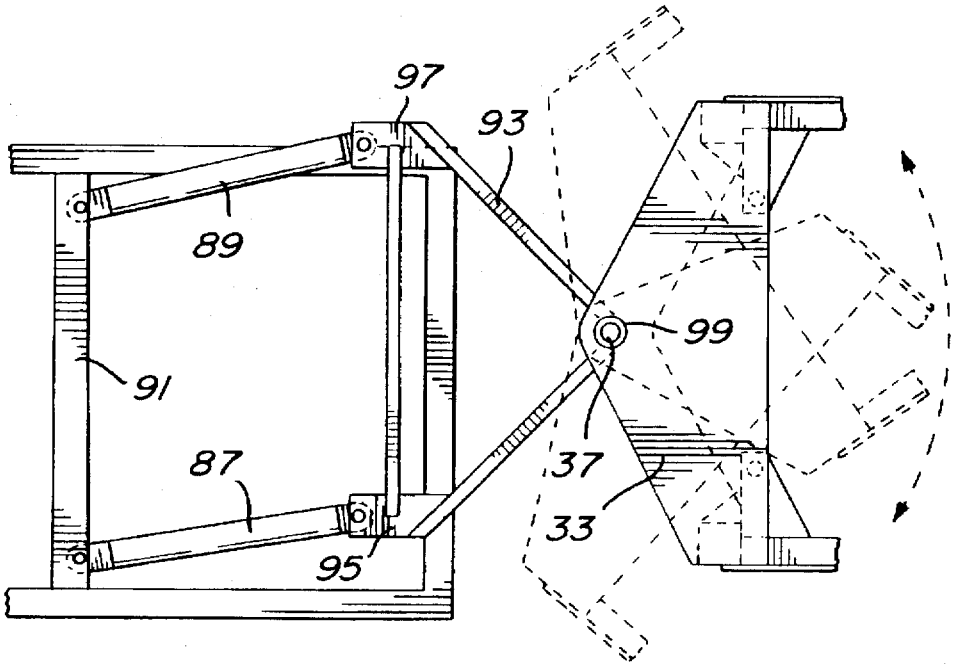
FIG. 9 is a view from above, showing the upper attachment with oscillation of the attachment to the forward motorized unit.

The snow levelling and packing device 9 is conventional and is merely used to pack snow including excess snow delivered by snow levelling device 7. It is mounted as shown in FIGS. 1 and 8 at the rear of unit 3, so as to be lifted from the ground when desired, such as by means of jack 177.

At the front of motorized unit 1, there is a conventional snow plough 11 which is mounted as shown.

Additional equipment, if desired may of course be mounted on or added to the machine according to the in example, an example, an additional snow levelling and packing device and/or a cutting device may be added at the rear of unit 3 preceding levelling and packing device 9. A snow tiller of known construction may also be added. Tracks have been used in the preferred embodiment, for propelling both motorized units. The particular type illustrated may of course vary at the choice of the builder of a machine according to the invention. For example, sprocket engagement of the tracks instead of tires may be used.

The cabin 21 includes all the controls (mechanical, electrical, electronic, pneumatic, hydraulic, or the like) to operate the machine and the exact design is left entirely to one skilled in the art. All connections from the front to the rear motorized units for this purpose are enclosed in cable duct 179.

Finally, in its illustrated embodiment, steering is achieved by providing a pair of hydraulic jacks 181,183. As will be realized by one skilled in the art, extension and retraction will cause the front motorized unit to be oriented in a predetermined direction. As shown, jacks 181,183 are mounted between frame 12 and frame 79 which is fixed to beams 69,71.

Modifications are possible without departing from the spirit and scope of the invention as will be appreciated by one skilled in the art.

We claim:

1. A machine for packing snow, which comprises a first motorized unit and a second motorized unit, each said unit having means enabling said machine to move over a surface covered with snow as well as a rough uneven terrain;

said first and second motorized units are each provided with self-propelling means, said machine also comprises means effective to cause simultaneous operation of both self-propelling means, said self-propelling means arranged to enable said first and second motorized units to travel exactly at the same speed;

means connecting said first motorized unit ahead of said second motorized unit;

steering means enabling said machine to change direction;

said connecting means comprising articulating means enabling to change the course of said machine by operating said steering means, and means to permit one unit to pivot about a vertical axis independently of the other unit;

first snow leveling means disposed between said first and said second motorized unit and carried by said connecting means to ride over a snow surface for breaking and leveling irregularities in said snow surface and delivering excess snow rearwardly of said second motorized unit;

second snow leveling means including packing means for leveling and packing snow including said excess snow delivered rearwardly of said second motorized unit, said second leveling means including packing means arranged behind said second motorized unit;

means connecting said second snow leveling means including packing means to said second motorized unit for pulling same while allowing it to slide over snow including said excess snow which is leveled by means of said leveling means; and means permitting said snow second leveling means including packing means to be raised from or lowered into ground engaging positions thereof.

2. A machine for packing snow according to claim 1, which comprises motor means disposed in one said motorized unit and arranged to operate said first and second motorized units so as to cause them to be simultaneously self-propelled.

3. A machine for packing snow according to claim 2, which wherein said motor means disposed in one said motorized unit.

4. A machine for packing snow according to claim 3, wherein said first motorized unit comprises first driving means, said second motorized unit comprises second driving means, said machine comprises a main drive shaft having an inner end and an outer end, said inner end being operatively connected to said motor means, said outer end being connected to a transfer case, a first auxiliary shaft connected between said transfer case and said first driving means to operate said first driving means, and a second auxiliary shaft connected between said transfer case and said second driving means to operate said second driving means, so that both said first and second driving means are being simultaneously operated by said motor means.

5. A machine for packing snow according to claim 4, wherein said first motorized unit comprises a first frame, a pair of first drive wheels and a pair of first non driven wheels mounted on said first frame, first and second tracks each respectively engaged over a first drive wheel and a first non driven wheel on both sides of said first motorized unit, said first auxiliary drive shaft operatively connected to said first drive wheels to drive said first motorized unit.

6. A machine for packing snow according to claim 4, wherein said second motorized unit comprises a second frame, a pair of second drive wheels and a pair of second non driven wheels mounted on said second frame, third and fourth tracks, each respectively engaged over a second drive wheel and a second non driven wheel on both sides of said second motorized unit, said second frame also having a motor mounted thereon, said motor being arranged to operate said main drive shaft, said second auxiliary drive shaft operatively connected to said second drive wheels to drive said second motorized unit.

7. A machine for packing snow according to claim 6, which comprises transmission means associated with said motor, said transmission means to transfer power from said motor to said main drive shaft and thereby also to said first and second drive wheels through said first and second auxiliary shafts.

8. A machine for packing snow according to claim 6, wherein said transmission means comprise an automatic transmission.

9. A machine for packing snow according to claim 7, wherein said connecting means comprise at least two parallel beams mounted on said second frame and extending along the longitudinal axis of said second motorized unit, said beams being joined together at their outer end by means of a transverse connecting bar, said beams having means located intermediate between said outer end and said second motorized unit to adjustably hold said first snow levelling means, said beams also comprising hitching means for coupling said beams to said first motorized unit so that said first motorized unit can be articulated about a vertical axis with respect to said beams, and be allowed to pivot about said longitudinal axis, independently of said beams and said second motorized unit.

10. A machine for packing snow according to claim 9, wherein said hitching means comprise a hitch support attached to said first frame at the rear of said first motorized unit, said hitch support including a first pair of lower rearwardly projecting holding members, an attachment ball between said lower holding members and means for fixedly retaining said attachment ball therebetween, said hitch support also including a second pair of upper rearwardly projecting holding members, a hitch pin between said upper holding members and means for retaining said hitch pin therebetween, said hitching means also comprising a hook member attached to said beams and engageable over said attachment ball to rotate in all directions relative thereto, an upper attachment fixed to said beams comprising a pair of pivoting arms and a joint attachment, said pivoting arms pivotally mounted at one end on said beams, said joint attachments pivotable at the other end of said pivoting arms, said upper attachment pivotally engaged by said hitch pin, so that when said first motorized unit merely pivots about a vertical axis said pivoting arms remain parallel to said beams, but when said first motorized unit undergoes a torsion about a longitudinal axis, said pivoting arms pivot at said one end thereby preventing the beams and consequently the second motorized unit from undergoing a similar torsion.

11. A machine according to claim 6, which comprises tandem means for mounting a drive wheel with a corresponding non driven wheel so that they can take up surface irregularities by pivoting about a pivot provided in said tandem means.

12. A machine for packing snow according to claim 9, wherein said first snow levelling means comprises a first snow levelling frame, a plurality of vertical snow cutting and ploughing blades, and means for mounting said blades on said first snow levelling frame.

13. A machine for packing snow according to claim 12, wherein said blades are shaped as elongated plates each formed with a sharp edge at the lower end thereof, said first snow levelling means comprising brackets for mounting said blades on said first snow levelling frame.

14. A machine according to claim 13, wherein said blades are arranged in pairs and are slanted so as to transfer excess snow rearwardly of said second motorized unit.

15. A machine according to claim 13, which comprises at least one pair of blades which are inwardly slanted and spaced from one another to allow said excess snow to be transferred rearwardly therebetween and at least one pair of blades which are outwardly slanted and arranged to transfer said excess snow around the outer ends thereof.

16. A machine according to claim 15, which comprises spring loaded means associated with said brackets to permit vertical upward and downward movement of said blades when in contact with an irregular surface.

17. A machine according to claim 12, which comprises means for adjustably mounting and raising and lowering said first snow levelling frame below said beams.

18. A machine for packing snow according to claim 17, wherein said mounting and raising and lowering means comprise a leverage rod, and means for rotatably mounting said rod on one said beam, lever arms at both end of said leverage rod, length adjustable mechanical links, each fixed at one end to said first snow levelling frame and at the other end to the respective free ends of said lever arms, and a hydraulic jack fixed at one end to a beam bracket downwardly extending from one said beam, and at the other end at an intermediate point of one said lever arm, so that extension of said first snow hydraulic jack will cause a lifting of said levelling frame through both said mechanical links.

19. A machine for packing snow according to claim 9, which comprises means for articulately lifting said second snow leveling means including packing means at the rear of said second motorized unit and control means provided in said front motorized unit to enable steering and operation of said machine.

20. A machine for packing snow according to claim 5, wherein said steering means comprise a pair of hydraulic jack mounted between said connection and the first frame of said front motorized unit and operable to orient said first motorized unit is a predetermined direction.

* * * * *